US007646273B2

(12) United States Patent
Kobayashi

(10) Patent No.: US 7,646,273 B2
(45) Date of Patent: Jan. 12, 2010

(54) SOLENOID ACTUATOR

(75) Inventor: Noboru Kobayashi, Hikone (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 159 days.

(21) Appl. No.: 11/902,241

(22) Filed: Sep. 20, 2007

(65) Prior Publication Data

US 2008/0074218 A1 Mar. 27, 2008

(30) Foreign Application Priority Data

Sep. 21, 2006 (JP) ..... 2006-256252

(51) Int. Cl.
*H01F 7/08* (2006.01)
*H01H 51/22* (2006.01)

(52) U.S. Cl. ..... 335/275; 335/78; 335/80

(58) Field of Classification Search ..... 335/78–86, 335/275, 276

See application file for complete search history.

(56) References Cited

U.S. PATENT DOCUMENTS

| | | | | |
|---|---|---|---|---|
| 2,632,071 | A | 3/1953 | Rinke | |
| 4,025,884 | A * | 5/1977 | Wright et al. | 335/129 |
| 4,492,942 | A | 1/1985 | Mueller | |
| 5,844,456 | A | 12/1998 | Mader | |
| 6,545,575 | B1 | 4/2003 | Hirabayashi et al. | |
| 2002/0067100 | A1 | 6/2002 | Rieck et al. | |

FOREIGN PATENT DOCUMENTS

| | | | |
|---|---|---|---|
| AT | 382 739 | B | 4/1987 |
| EP | 1 154 452 | A1 | 11/2001 |
| JP | 31-008446 | Y | 6/1956 |
| JP | 56-140437 | U | 10/1981 |
| JP | 58-093305 | A | 6/1983 |
| JP | 62-202743 | U | 12/1987 |
| JP | 64-48842 | U | 3/1989 |
| JP | 01-140605 | A | 6/1989 |
| JP | 02-090502 | A | 3/1990 |
| JP | 2001-212297 | A | 8/2001 |
| WO | WO-01/24212 | A1 | 4/2001 |

OTHER PUBLICATIONS

Notification of Reasons for Refusal for the Application No. 2006-256252 from Japan Patent Office mailed Oct. 7, 2008.

European Search Report for the Application No. EP 07 01 7220 dated Mar. 18, 2009.

Notification of Reasons for Refusal for the Application No. 2006-256252 mailed Mar. 31, 2009.

* cited by examiner

*Primary Examiner*—Ramon M Barrera
(74) *Attorney, Agent, or Firm*—Cheng Law Group, PLLC

(57) ABSTRACT

A solenoid actuator assembled from a minimum number of parts. The solenoid actuator includes a coil bobbin carrying an excitation coil, a core extending through the coil bobbin, and an armature having an actuator leg and an angled anchor leg. The core has a first pole end and a second pole end respectively at its opposite ends. A hinge support is provided to pivotally support the armature to the core, and is formed as an integral part of the coil bobbin and is disposed at one axial end of the core to place the anchor leg in close relation to the first pole end, and at the same time to place a portion of the actuator leg in close relation to the second pole end. The hinge support is configured to make the anchor leg in direct supporting contact with the first pole end.

3 Claims, 5 Drawing Sheets

SOLENOID ACTUATOR

TECHNICAL FIELD

The present invention is directed to a solenoid actuator, and more particularly to such actuator of hinged flapper type.

BACKGROUND ART

Japanese Patent Publication No. 2001-212297 A discloses a prior art solenoid actuator of the hinged flapper type. The actuator includes an excitation coil wound around a coil bobbin, a core extending through the coil bobbin, and an armature extending along an axial direction of the coil. The core projects axially outwardly of the coil or the coil bobbin to provide a first pole end and a second pole end respectively at the opposite axial ends of the coil. The armature extends generally along the axial length of the coil and is pivotally supported to the core by means of a hinge spring with one end of the armature held close to the first pole end and with the other end held close to the second pole end. Upon energization of the coil, a magnetic attraction force develops to attract the one end of the armature towards the second pole end, causing the armature to pivot against the bias of the hinge spring. In this prior art solenoid actuator, a yoke is attached to the first pole end of the core for magnetically couple the armature to the core as well as for holding the hinge spring on the side of the core. Although the solenoid actuator makes the use of the full length of the coil to give a relatively long stroke to one end of the armature, it requires the yoke as well as the hinge spring as discrete parts in addition to the core, the coil, and the coil bobbin, eventually increasing a cost as well as inconvenience of assembling the solenoid actuator.

DISCLOSURE OF THE INVENTION

The above insufficiency has been eliminated in the present invention which provides an improved solenoid actuator capable of being assembled with a minimum number of parts. The solenoid actuator in accordance with the present invention includes a coil bobbin carrying therearound an excitation coil, a core extending through the coil bobbin, and an armature having an actuator leg extending outwardly and along an axial length of the coil. The coil is adapted for connection with an external voltage source to be selectively energized thereby. The core has its opposite ends projected axially outwardly of the coil to provide a first pole end and a second pole end respectively at its opposite ends. A hinge support is provided to pivotally support the armature to the core for allowing the armature to pivot between an operative position and an inoperative position. The armature is shaped to include an anchor leg which extends from one end of the actuator leg at an angled relation thereto. The hinge support is formed as an integral part of the coil bobbin and is disposed at one axial end of the core to place the anchor leg in close relation to the first pole end, and at the same time to place a portion of the actuator leg in close relation to the second pole end. Further, the hinge support is configured to make the anchor leg in direct supporting contact with the first pole end. Since the hinge support is provided as an integral part of the coil bobbin, the armature can be assembled without requiring any additional part to a solenoid block composed of the coil bobbin, the coil and the core. Thus, the solenoid actuator can be assembled with a minimum number of parts with an attendant cost saving and enhanced yield.

Preferably, the first pole end is configured to have a flat end face with a pivot edge and an opposite edge, the pivot edge being located further away from the actuator leg than the opposite edge. In this connection, the hinge support is configured to bring the anchor leg into an edge contact with the pivot edge of the flat end face to form therebetween a gap which is wider towards the opposite edge than at the pivot edge when the armature is in the inoperative position such that the anchor leg is caused to pivot above the pivot edge to move the armature to the operative position in response to the energization of the excitation coil. Thus, the magnetically attracting force developed between the first pole end and the anchor leg can be effectively utilized to pivot the anchor leg also on the side of the first pole end, giving a smooth and effective pivotal movement to the armature. The actuator leg is preferred to be angled to the anchor leg at an angle of less than 90 degrees.

Most preferably, the hinge support is configured to have a slot receiving therethrough the anchor leg, a pair of side stops spaced apart in a width direction of the anchor leg for confining therebetween the anchor leg, and an end stop which comes into engagement with an end of the anchor leg for retaining the anchor leg in the slot. With this arrangement, the anchor leg or the armature can be only permitted to undergo the intended pivot movement, while being retained to the coil bobbin, which assures a reliable armature movement, yet with a simple assembling structure.

Further, the solenoid actuator may be provided with a return element which is disposed between the actuator leg and an extension of the coil bobbin to resiliently return said armature to the inoperative position upon deenergization of the excitation coil. The return element is disposed at a portion opposite of the first pole end from the second pole end along the axial direction of the excitation coil or the core.

Alternatively, the actuator leg is configured to give resiliency against which the actuator leg is attracted to the second pole end upon energization of the excitation coil. In this instance, the actuator leg itself constitutes the return element, thereby contributing to reduce the number of the parts.

These and still other advantageous features of the present invention will become more apparent from the following detailed description of a preferred embodiment of the present invention when taken in conjunction with the attached drawings.

BEST MODE FOR CARRYING OUT THE INVENTION

Figure 1:
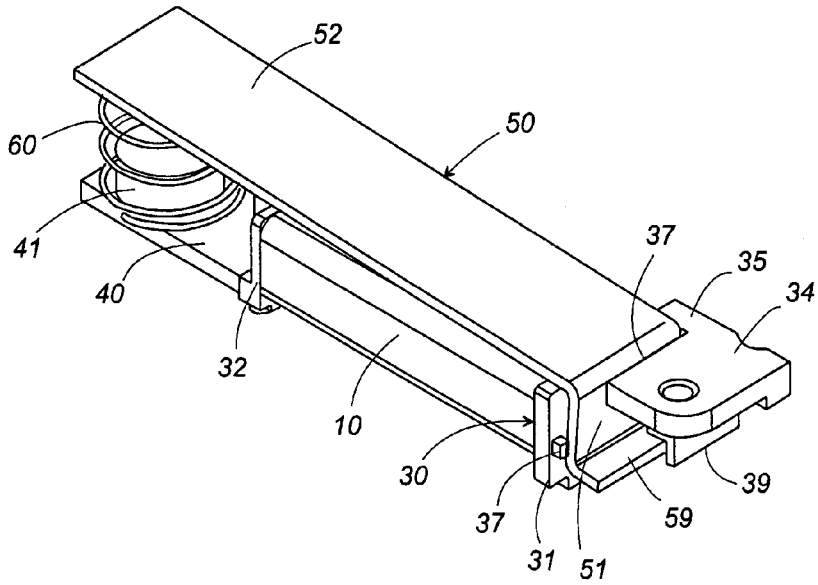
FIG. 1 is a perspective view of a solenoid actuator in accordance with a preferred embodiment of the present invention.
Figure 2:
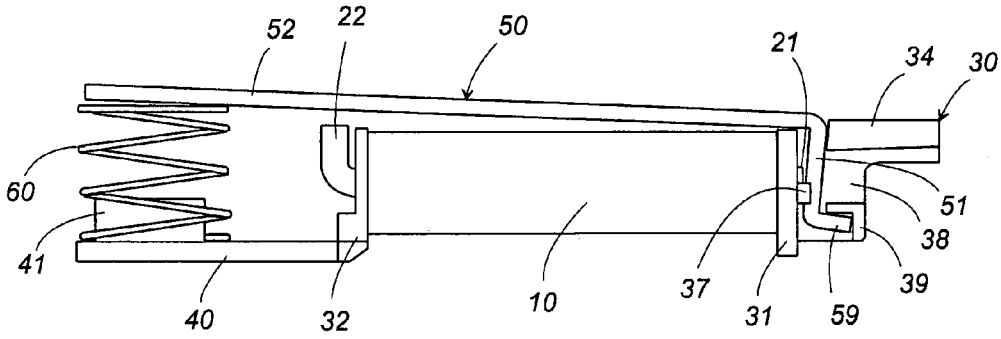
FIG. 2 is a front view of the above solenoid actuator.
Figure 3:
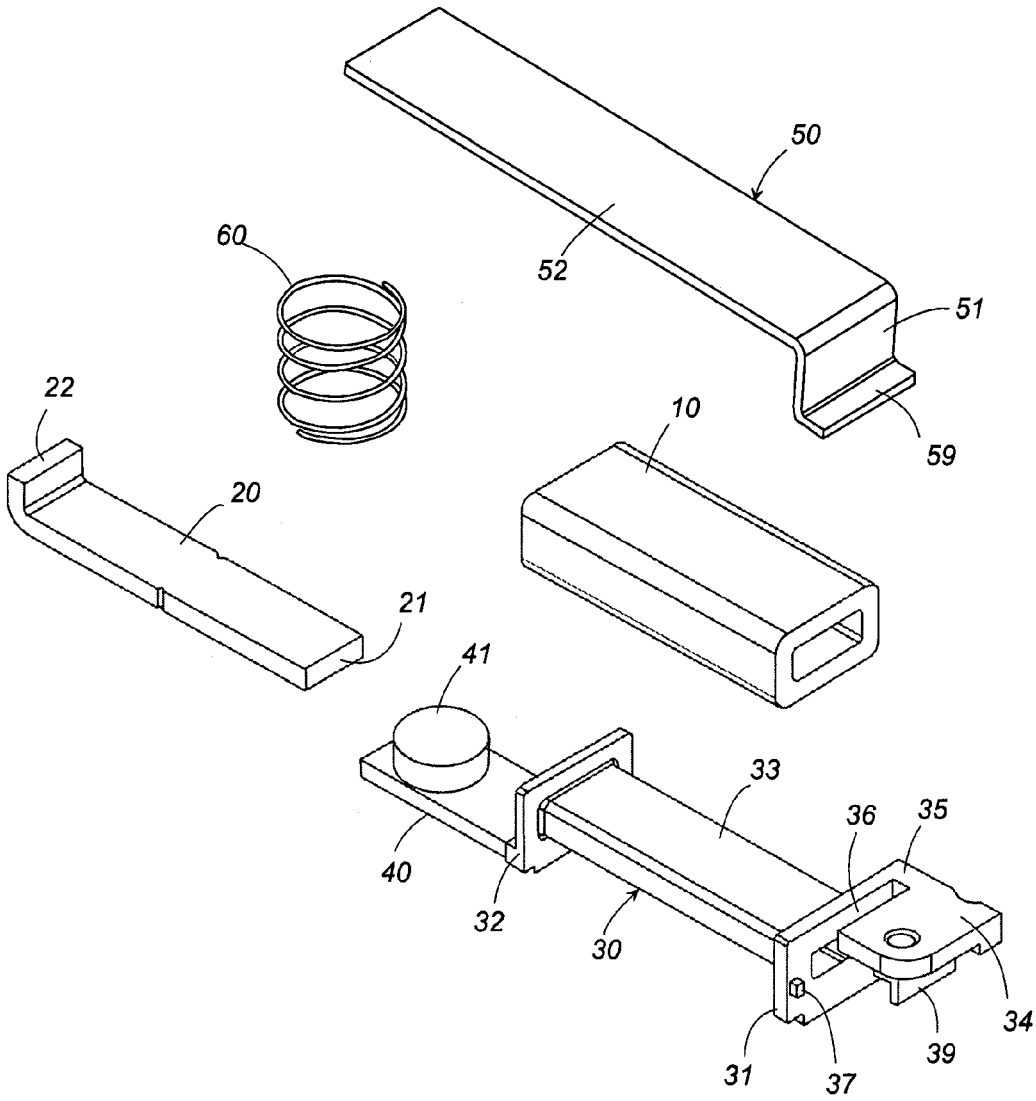
FIG. 3 is an exploded perspective view of the above solenoid actuator.

Referring now to FIGS. 1 to 3, there is shown a solenoid actuator in accordance with a preferred embodiment of the present invention. The solenoid actuator includes a solenoid block or electromagnet block, and an armature 50 which is driven by the block to actuate an object or part coupled to the armature. The solenoid block is composed of an excitation coil 10 wound around a coil bobbin 30, and a core 20 extending through the coil bobbin 30. The excitation coil 10 is wounded into an elongated flat shape and is adapted to be connected to an external voltage source to be selectively energized thereby. The coil bobbin 30 is molded from a dielectric plastic material into a single piece having a barrel 33 mounting therearound the excitation coil 10, a pair of axially spaced flanges 31 and 32 at opposite ends of the barrel 33, a ledge 34 extending from the one flange 31, and an extension 40 extending from the other flange 32. The core 20 is made of a magnetic material to have its opposite ends projected respectively axially outwardly of the excitation coil 10 to define a first pole end 21 outwardly of the flange 31 and a second pole end 22 outwardly of the flange 32. The armature 50 is made of a magnetic material to include an actuator leg 52 elongated along an axial length of the coil bobbin 30 and an anchor leg 51 which is bent from one end of the actuator leg at an angle of less than 90 degrees. The actuator leg 52 is adapted to be coupled or contacted to the object to be driven by the solenoid actuator.

Figure 4:
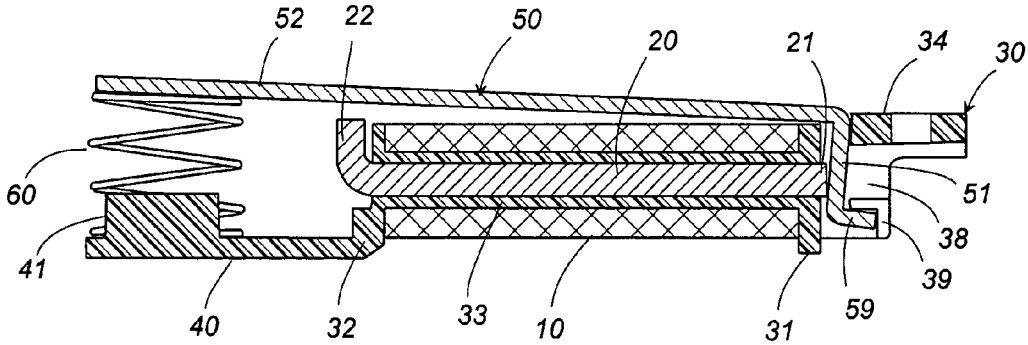
FIGS. 4 and 5 are sectional views illustrating the above solenoid actuator respectively in its inoperative and operative positions.
Figure 5:
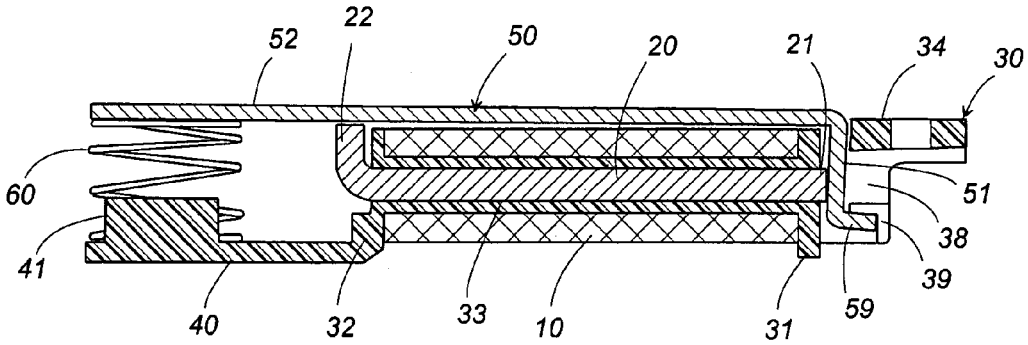
Figure 6:
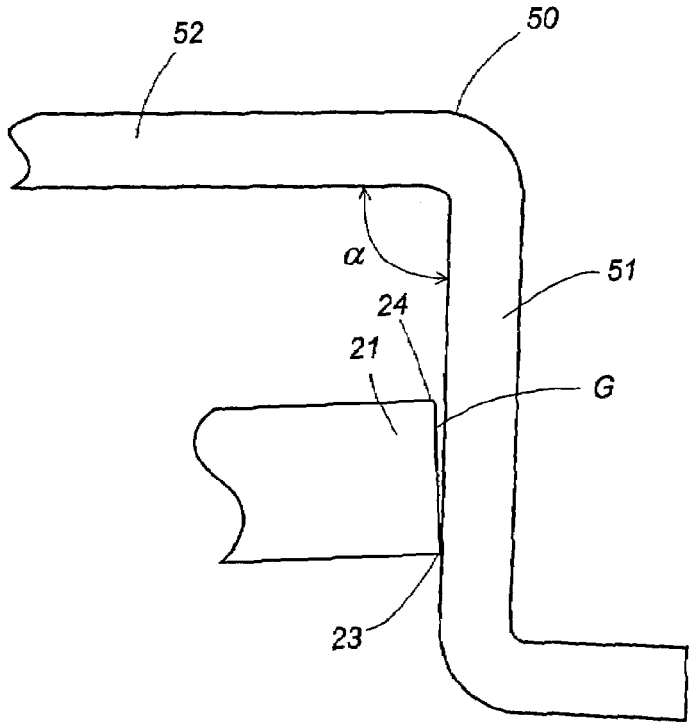
FIG. 6 is an enlarged view illustrating a portion of the above solenoid actuator.

The ledge 34 is cooperative with the adjacent flange 31 to define a hinge support which supports the armature 50 to the coil bobbin 30, and allows the armature 50 to pivot between an inoperative position of FIG. 4 and an operative position of FIG. 5, in response to deenergization and energization of the excitation coil 10. The ledge 34 projects axially outwardly from the upper end of the flange 31 through a narrowed bridge 35 at one width end of the flange 31 to define a slot 36 between the ledge 34 and the upper end of the flange 31. The slot 36 is opened at its width end to permit the entry of the anchor leg 51 from sideward when assembling the armature 50 to the solenoid block. The flange 31 is formed at its one width end with a projection 37 which is laterally spaced from the bridge 35 and is cooperative therewith to act as a pair of laterally spaced side stops for retaining the anchor leg 51 therebetween. The narrowed bridge 35 is given sufficient resiliency to temporarily deform the ledge 34 in a direction of widening the slot 36 when inserting the anchor leg 51 into the slot 36 past the projection 37, after which the ledge 34 returns to place the anchor leg 51 between the side stops, i.e., the projection 37 and the bridge 35. A side wall 38 depends from one width end of the ledge 34 and is formed with an angled end stop 39 which is positioned below the ledge 34 for engagement with a hook 59 at the lower end of the anchor leg 51, as best shown in FIG. 2. By engagement of the hook 59 with the end stop 39, the armature 50 is retained to the coil bobbin 30 and is prevented from being slipping out of the coil bobbin upwardly through the slot 36. The slot 36, the projection 37, and the end stop 39 are dimensioned and positioned so that the armature 50 is supported to the coil bobbin 30 with the anchor leg 51 comes into direct contact with the first pole end 21, as shown in FIG. 6, in the absence of the magnetic force developed by the excitation coil 10, while being allowed to pivot between the inoperative position of FIG. 4 and the operative position of FIG. 5. In the inoperative position of FIG. 4, a slight clearance is made between the upper end of the flange 31 and the actuator leg 52 to permit the pivotal movement of the armature 50 towards the operative position of FIG. 5

The armature 50 is spring-biased by a coil spring 60 towards the inoperative position of FIG. 4, and is driven to pivot against the bias towards the operative position of FIG. 5 when the excitation coil 10 is energized. Upon energization of the excitation coil 10, a resulting magnetic force causes the actuator leg 52 to be attracted to the second pole end 22, with an attendant pivot movement of the armature 50. The second pole end 52 is bent upwardly at right angles for effectively attracting the actuator leg 52. The coil spring 60, provided as one example of a return element, is interposed between the free end of the actuator leg 52 and the extension 40 integrally extending axially outwardly of the flange 32 of the coil bobbin 30, and is fitted over a stud 41 on the extension 40.

Figure 7:
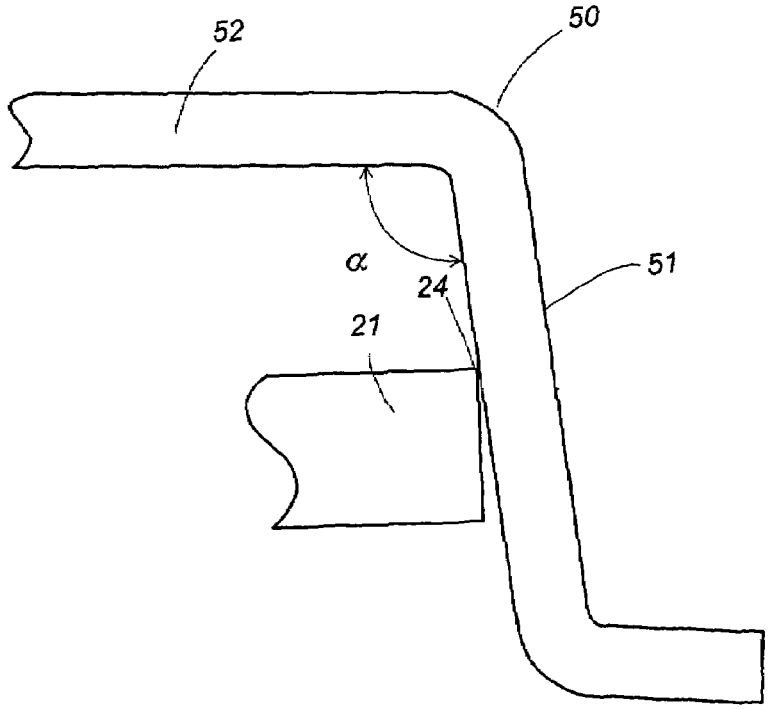
FIG. 7 is a partial view illustrating a like portion of a comparative solenoid actuator.

As shown in FIG. 6, the first pole end 21 of the core 20 has a flat end face with a pivot edge 23 and an opposed edge 24, respectively at its lower and upper ends. When the armature 50 is in the inoperative position of FIG. 6, the anchor leg 51 is kept in edge contact with the pivot edge 23 to leave, between the anchor leg 51 and the first pole end 21, a gap G which becomes wider towards the opposite edge 24 than at the pivot edge 23. Therefore, the magnetically attracting force developed between the first pole end 21 and the anchor leg 51 acts to pivot the armature 50 toward the operative position, in an additive relation to the magnetic attracting force acting between the actuator leg 52 and the second pole end 22. This arrangement is achieved by the pivot support of the armature as described in the above in combination with the armature's configuration that the anchor leg 51 is bent at an angle ($\alpha$) of less than 90 degrees with respect to the actuator leg 52, and is found advantageous over a possible arrangement of FIG. 7 in which the anchor leg 51 is bent at an angle ($\alpha$) of more than 90 degrees with respect to the actuator leg 52 and comes into an edge contact with the upper edge 24 of the first pole end so as to pivot about the upper edge. In this situation, the magnetically attracting force between the anchor leg 51 and first pole end 21 is opposed to the magnetically attracting force developed between the actuator leg 52 and the second pole end, thereby impeding the pivotal movement of the armature.

It is noted in this connection that the movement of the armature 50 towards the operation position of FIG. 5 is restricted by engagement of the hook 59 to the end stop 39 such that the anchor leg 51 does not come into face contact with the first pole end 21 in the operative position of FIG. 5, and is still held in the edge contact with the first pole end 21, even when the actuator leg 52 comes into a parallel relation with an axis of the core 20 for reason of that the anchor leg 51 is bent from the actuator leg 52 at the angle of less than 90 degrees.

Figure 8:
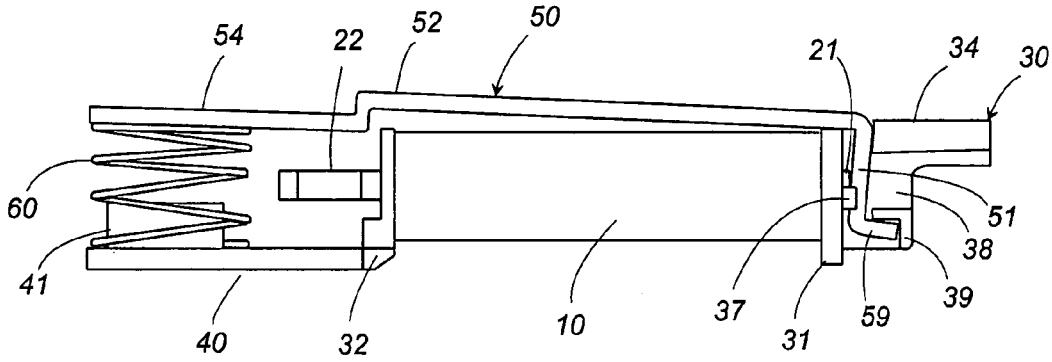
FIG. 8 is a front view illustrating a modification of the above solenoid actuator.

FIG. 8 shows a modification of the above embodiment in which the actuator leg 52 has its end shaped into a stepped-down member 54 close to the second pole end 22 which extends straight out from the coil bobbin 30 rather than being bent upwardly. The like parts are designated by like reference numerals as in the first embodiment. The modification is advantageous for giving a low-profile structure. Also in this modification, the coil bobbin 30 is best utilized to support the coil spring 60 on its extension 40, thereby enabling to assembly the coil sprig without requiring any additional discrete part.

Figure 9:
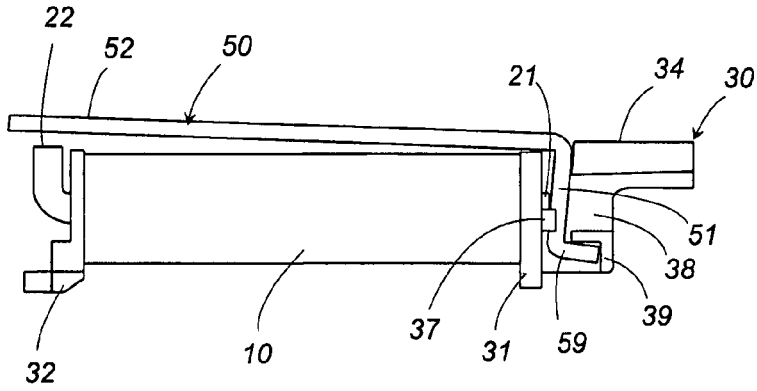
FIG. 9 is a front view illustrating a solenoid actuator in accordance with another embodiment of the present invention.

FIG. 9 shows another embodiment of the present invention which is identical to the above embodiment except that the actuator leg 52 is configured to be given resiliency which biases the armature 50 to keep it in the inoperative position while the excitation coil is deenergized. Like parts are designated by like reference numerals. In the inoperative position, the anchor leg 51 may be held in the edge contact with or even in an out of contact from the first pole end 21. When the excitation coil 10 is energized, the actuator leg 52 is attracted towards the second pole end 22 as being resiliently deformed with being accompanied by the pivotal movement of the armature 50. That is, after the armature 50 pivots to a point where the hook 59 engages with the end stop 39, the actuator 52 is attracted towards the second pone end 22 as being resiliently deformed so as to move the armature to the operative position. After removal of the attracting force acting of the actuator leg 52 in response to the deenergization of the coil, the resiliency of the actuator leg 52 forces the actuator 50 back to the inoperative position. In this consequence, the solenoid actuator of the present invention can eliminate the return element as well as the supporting member thereof, which contributes to reduce the axial length.

Although the above embodiments and modification is explained the anchor leg 51 held in the edge contact with the first pole end 21 in its operative position, the hinge support is configured to provide some tolerance between the anchor leg 51 and the first pole end 21 so that the anchor leg 51 may be kept spaced apart from the first pole end in a strict sense in the inoperative position, but is so configured as to bring the anchor leg 51 into the edge contact at the very instant of energizing the excitation coil 10, assuring to make subsequent pivot movement of the armature 50 successfully.

What is claimed is:

1. A solenoid actuator comprising:

a coil bobbin;

an excitation coil wound around said coil bobbin for connection with an external voltage source to be selectively energized thereby;

a core configured to extend through said coil bobbin to have a first pole end and a second pole end which project outwardly of said excitation coil respectively at opposite axial ends thereof;

an armature having an actuator leg extending outwardly of said excitation coil and along an axial length of said excitation coil;

a hinge support configured to pivotally support said armature to said core for pivotal movement of said armature between an operative position and an inoperative position;

wherein said armature is shaped to include an anchor leg which extends from one end of said actuator leg at an angled relation thereto, said hinge support is formed as an integral part of said coil bobbin and is disposed at one axial end of said core to place said anchor leg in close relation to said first pole end, and at the same time to place a portion of said actuator leg in close relation to said second pole end, said hinge support being configured to make said anchor leg in direct supporting contact with said first pole end, and wherein said actuator leg is angled to said anchor leg at an angle of less than 90 degree.

2. A solenoid actuator comprising:

a coil bobbin;

an excitation coil wound around said coil bobbin for connection with an external voltage source to be selectively energized thereby;

a core configured to extend through said coil bobbin to have a first pole end and a second pole end which project outwardly of said excitation coil respectively at opposite axial ends thereof;

an armature having an actuator leg extending outwardly of said excitation coil and along an axial length of said excitation coil;

a hinge support configured to pivotally support said armature to said core for pivotal movement of said armature between an operative position and an inoperative position;

a return element is disposed between said actuator leg and an extension of said coil bobbin to resiliently return said armature to said inoperative position upon deenergization of said excitation coil, said return element being disposed at a portion opposite of said first pole end from said second pole end along the axial direction of said excitation coil;

wherein said armature is shaped to include an anchor leg which extends from one end of said actuator leg at an angled relation thereto, said hinge support is formed as an integral part of said coil bobbin and is disposed at one axial end of said core to place said anchor leg in close relation to said first pole end, and at the same time to place a portion of said actuator leg in close relation to said second pole end, said binge support being configured to make said anchor leg in direct supporting contact with said first pole end.

3. A solenoid actuator comprising:

a coil bobbin;

an excitation coil wound around said coil bobbin for connection with an external voltage source to be selectively energized thereby;

a core configured to extend through said coil bobbin to have a first pole end and a second pole end which project outwardly of said excitation coil respectively at opposite axial ends thereof;

an armature having an actuator leg extending outwardly of said excitation coil and along an axial length of said excitation coil;

a hinge support configured to pivotally support said armature to said core for pivotal movement of said armature between an operative position and an inoperative position;

wherein said armature is shaped to include an anchor leg which extends from one end of said actuator leg at an angled relation thereto, said hinge support is formed as an integral part of said coil bobbin and is disposed at one axial end of said core to place said anchor leg in close relation to said first pole end, and at the same time to place a portion of said actuator leg in close relation to said second pole end, said hinge support being configured to make said anchor leg in direct supporting contact with said first pole end, and wherein said actuator leg is configured to give resiliency against which the actuator leg is attracted to said second pole end upon energization of said excitation coil.

* * * * *